US010246843B1

(12) United States Patent
Adams

(10) Patent No.: US 10,246,843 B1
(45) Date of Patent: Apr. 2, 2019

(54) FILLABLE BARRIER BAG

(71) Applicant: Beau G. Adams, Louisville, KY (US)

(72) Inventor: Beau G. Adams, Louisville, KY (US)

( * ) Notice: Subject to any disclaimer, the term of this patent is extended or adjusted under 35 U.S.C. 154(b) by 0 days.

(21) Appl. No.: 15/785,123

(22) Filed: Oct. 16, 2017

Related U.S. Application Data

(63) Continuation of application No. 14/731,963, filed on Jun. 5, 2015, now abandoned.

(60) Provisional application No. 62/008,850, filed on Jun. 6, 2014.

(51) Int. Cl.
*E02B 3/00* (2006.01)
*E02B 3/10* (2006.01)
*E06B 9/00* (2006.01)

(52) U.S. Cl.
CPC ..... *E02B 3/108* (2013.01); *E06B 9/00* (2013.01); *E06B 2009/007* (2013.01)

(58) Field of Classification Search
CPC ..... E02B 3/108; E02B 9/02; E02B 2009/007
See application file for complete search history.

(56) References Cited

U.S. PATENT DOCUMENTS

| | | | |
|---|---|---|---|
| 1,406,068 | A | 2/1922 | Padgett |
| 1,418,403 | A | 6/1922 | Smith |
| 1,475,603 | A | 11/1923 | Sheridan |
| 1,983,418 | A | 12/1934 | Thurmer |
| 2,570,851 | A | 10/1951 | Peyser |
| 2,586,557 | A | 2/1952 | Newbold |
| 2,672,903 | A | 3/1954 | Machinist |
| 2,767,936 | A | 10/1956 | Ringen et al. |
| 2,813,704 | A | 11/1957 | MacKissic |
| 3,552,346 | A | 1/1971 | Garden |
| 3,886,751 | A | 6/1975 | Porraz Jimenez Labora |
| 4,126,213 | A | 11/1978 | McDonald |
| 4,184,522 | A | 1/1980 | Waite |
| 4,362,433 | A | 12/1982 | Wagner et al. |
| 4,650,368 | A | 3/1987 | Bayer |
| 4,674,127 | A | 6/1987 | Yamada et al. |
| 4,700,818 | A | 10/1987 | Orwin |
| 4,784,520 | A | 11/1988 | Stevens |
| 5,015,123 | A | 5/1991 | Houck et al. |
| 5,051,028 | A | 9/1991 | Houck et al. |
| 5,154,543 | A | 10/1992 | Houck et al. |
| 5,176,468 | A | 1/1993 | Poole |
| 5,244,019 | A | 9/1993 | Derby |
| 5,333,970 | A | 8/1994 | Heselden |
| 5,378,357 | A | 1/1995 | Houck et al. |

(Continued)

FOREIGN PATENT DOCUMENTS

| | | |
|---|---|---|
| EP | 2299003 | 3/2011 |
| JP | 11029151 | 2/1999 |

(Continued)

OTHER PUBLICATIONS

International Search Report and Written Opinion for PCT/US2013/064873 dated Jul. 9, 2014.

(Continued)

*Primary Examiner* — Benjamin F Fiorello
(74) *Attorney, Agent, or Firm* — Middleton Reutlinger

(57) ABSTRACT

Apparatus and methods relating to a barrier bag are disclosed herein. In one embodiment, the barrier bag is configured for installation in a doorway and includes a receiving cell for receiving a second barrier bag. The barrier bag may include removable attachment portions for attaching it to one or more additional barrier bags.

8 Claims, 10 Drawing Sheets

(56) References Cited

U.S. PATENT DOCUMENTS

| | | | |
|---|---|---|---|
| 5,425,403 | A | 6/1995 | Herrmann |
| 5,443,102 | A | 8/1995 | Svendsen |
| 5,509,229 | A | 4/1996 | Thomasson et al. |
| 5,535,499 | A | 7/1996 | Houck et al. |
| 5,538,155 | A | 7/1996 | Hoekstra |
| 5,584,599 | A | 12/1996 | Knittel |
| 5,605,416 | A | 2/1997 | Roach |
| 5,647,695 | A | 7/1997 | Hilfiker et al. |
| 5,771,665 | A | 6/1998 | Nelson et al. |
| 5,894,871 | A | 4/1999 | Greer |
| 5,901,762 | A | 5/1999 | Rollins |
| 5,971,661 | A | 10/1999 | Johnson et al. |
| 5,988,237 | A | 11/1999 | Bedsole |
| 6,126,362 | A | 10/2000 | Carter |
| 6,334,736 | B1 | 1/2002 | Johnson |
| 6,390,154 | B1 | 5/2002 | Hall |
| 6,637,474 | B2 | 10/2003 | Hall |
| 6,672,799 | B2 | 1/2004 | Earl |
| 6,708,835 | B1 | 3/2004 | Mathis |
| 6,994,132 | B2 | 2/2006 | Antrobus |
| 7,056,058 | B2 | 6/2006 | Urriola et al. |
| 7,237,753 | B2 | 7/2007 | Metcalfe |
| 7,281,879 | B2 | 10/2007 | Cho |
| 7,431,534 | B2 | 10/2008 | Harbeck |
| 7,651,298 | B2 | 1/2010 | Boudreaux, Jr. |
| 7,708,495 | B1 | 5/2010 | Antee |
| 7,794,148 | B2 | 9/2010 | Derby et al. |
| 7,900,757 | B2 | 3/2011 | Sisitsky |
| 7,918,996 | B1 | 4/2011 | de Bruijn |
| 7,922,421 | B2 | 4/2011 | McGillick et al. |
| 7,958,995 | B2 | 6/2011 | Dedmon et al. |
| D655,426 | S | 3/2012 | Otten |
| 8,235,631 | B2 | 8/2012 | Adams et al. |
| 8,382,398 | B2 | 2/2013 | Stauffacher |
| 8,602,692 | B2 | 12/2013 | Adams et al. |
| 8,672,585 | B2 | 3/2014 | Schnaars, Sr. et al. |
| 8,678,652 | B1 | 3/2014 | Nattrass |
| 8,721,221 | B2 | 5/2014 | Cavenagh |
| 8,864,411 | B2 | 10/2014 | Taylor |
| 9,004,815 | B2 | 4/2015 | Taylor |
| 9,260,830 | B2 | 2/2016 | Schneider |
| 9,267,251 | B2 | 2/2016 | Adams |
| 2001/0027826 | A1 | 10/2001 | Carpenter |
| 2004/0156680 | A1 | 8/2004 | Gibbs |
| 2006/0222270 | A1 | 10/2006 | Modena |
| 2007/0140598 | A1 | 6/2007 | McGillick, Sr. et al. |
| 2010/0278591 | A1 | 11/2010 | Tasker |
| 2012/0195687 | A1 | 8/2012 | Beard et al. |
| 2012/0207406 | A1 | 8/2012 | Cavenagh et al. |
| 2012/0230766 | A1 | 9/2012 | Schnaars, Sr. et al. |
| 2014/0021144 | A1 | 1/2014 | Lane |
| 2014/0050537 | A1 | 2/2014 | Adams |
| 2014/0102581 | A1 | 4/2014 | Adams |
| 2014/0105684 | A1 | 4/2014 | Allard |
| 2014/0226918 | A1 | 8/2014 | Adams |
| 2015/0023733 | A1 | 1/2015 | Schnaars, Sr. et al. |

FOREIGN PATENT DOCUMENTS

| | | |
|---|---|---|
| JP | 11190015 | 7/1999 |
| JP | 2000129646 | 5/2000 |
| JP | 2003074061 | 3/2003 |

OTHER PUBLICATIONS

International Search Report and Written Opinion for PCT/US2013/064875 dated Jan. 17, 2014.

FILLABLE BARRIER BAG

TECHNICAL FIELD

Generally, a fillable or refillable barrier bag is disclosed. More specifically, present embodiments relate to a bag that may be filled with flowable material and placed to impede the ingress of water. Two or more barrier bags may be interconnected with each other.

BACKGROUND

Flood control and levee systems have been achieved by utilizing one time sand bags and the like. However, such bags may only be used for a single installation and are not reusable. Further, these bags must be stacked vertically to prevent flooding, which is labor intensive. These bags are generally destroyed when removed from the installation.

Further, one time use sand bags and the like, even if they could be removed from an installation, cannot be moved together or in unison as they are placed individually without sufficient connection to other bags. This lack of connection also increases the likelihood of a gap existing between adjacent bags through which flood waters or the like may flow.

Thus, there is a need in the art for overcoming the issues of existing systems.

SUMMARY

The present disclosure is directed towards methods and apparatus for a barrier bag. The barrier bag is, in various embodiments, a bag that may be filled with a flowable material such as sand, which may then be emptied after use, and is sized and/or configured for placement in a doorway. The bag may be reconditioned and/or reused following use at an installment subject to flood waters. The bag may include one or more loading cells configured to receive the flowable material and/or may include a lid that may be opened to allow filling of the bag and closed to secure the flowable material in the one or more loading cells. Further, the bag may include a receiving cell one on end that is configured to receive the other end of the bag so that multiple barrier bags can be attached together. Such attachment may facilitate transferring of the bags as a group, instead of individually, whether filled or emptied, and/or may enhance the ability of the attached bags to prevent ingress of flood waters, for example, through a doorway. To facilitate connection and disconnection of multiple bags, removably attachable mechanisms may be employed to connect a first bag to a second bag so that the bags may be detached and reattached as a user sees fit.

Generally, in one aspect, the barrier bag includes one or more loading cells, each of which include a bottom panel and a plurality of side panels, creating an open-top internal space, which flowable fillable material can be placed into. The interior portions of a loading cell are defined by a bottom panel, a first and a second side panel, and a first and a second end panel, and the internal space of the barrier bag may contain partitions. Further, the barrier bag has a first and second end panel at opposing longitudinal ends of the bag. The second end panel contains a substantially open receiving cell configured to attach to the first end of an additional barrier bag. The receiving cell of the barrier bag extends longitudinally outward from the second end panel and includes a bottom extension panel and a first and a second side extension panel which form the bottom and sides of the receiving cell. In order to facilitate removable attachment of the receiving cell to the first end panel of an additional barrier bag, the receiving cell also includes extension straps which extend longitudinally outward beyond the terminal end of the receiving cell and are configured to removably attach to attachment portions on the first end panel of an additional receiving cell.

In some embodiments, the barrier bag may include a lid that removably attaches to the end or side panels to allow for enclosure of the interior space. Closure of the interior space may aid in retaining fill material of the bag.

In still other embodiments, the barrier bag may include handles attached to the end or side panels. Handles on the barrier bags would facilitate the manual lifting and moving of the bag.

In various embodiments, the barrier bag may be constructed to be reusable.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, and emphasis instead generally placed upon illustrating the principals of the embodiments depicted.

DETAILED DESCRIPTION

Figure 1:
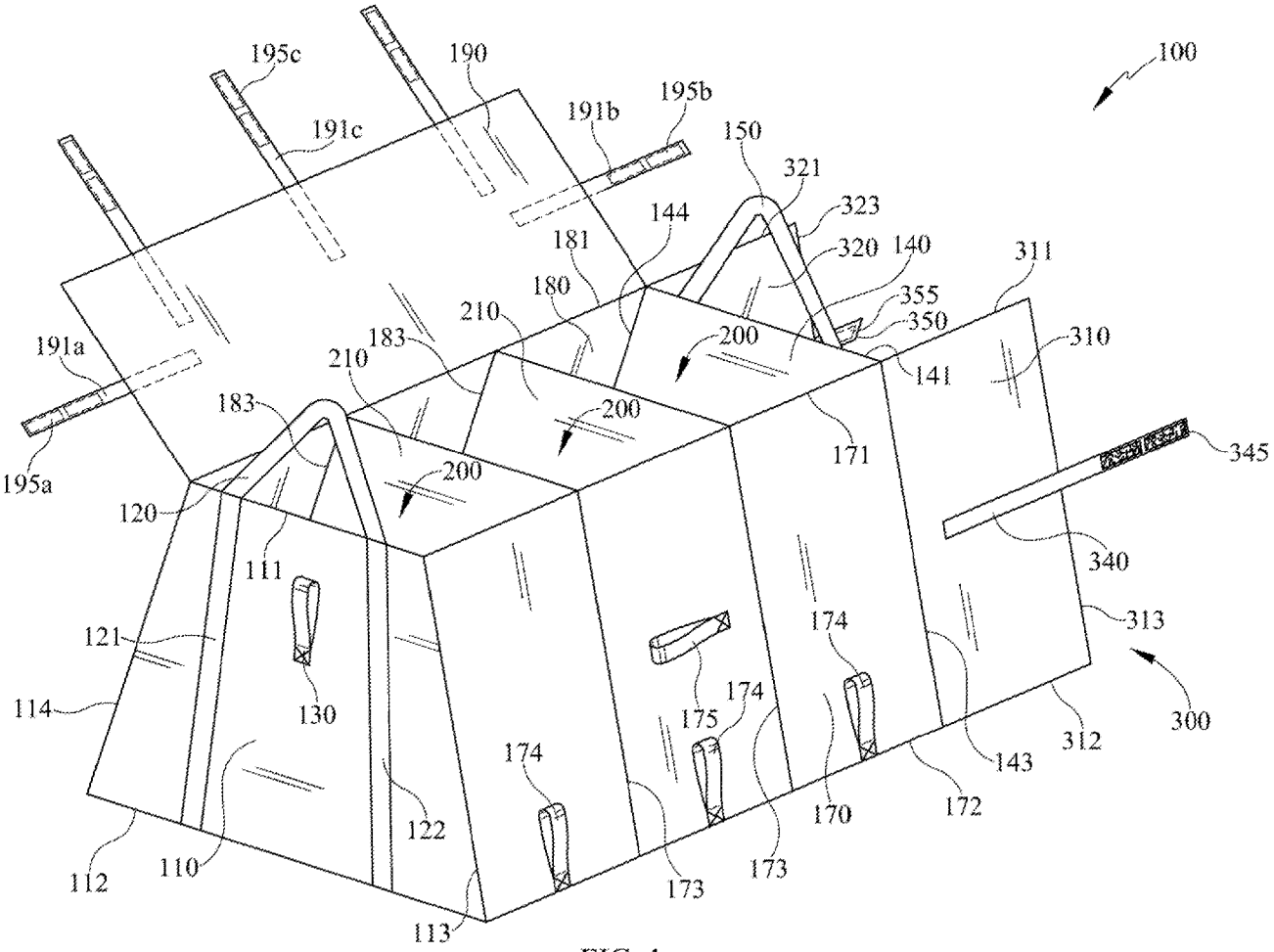
FIG. 1 is a perspective view of an embodiment of a barrier bag.
Figure 2:
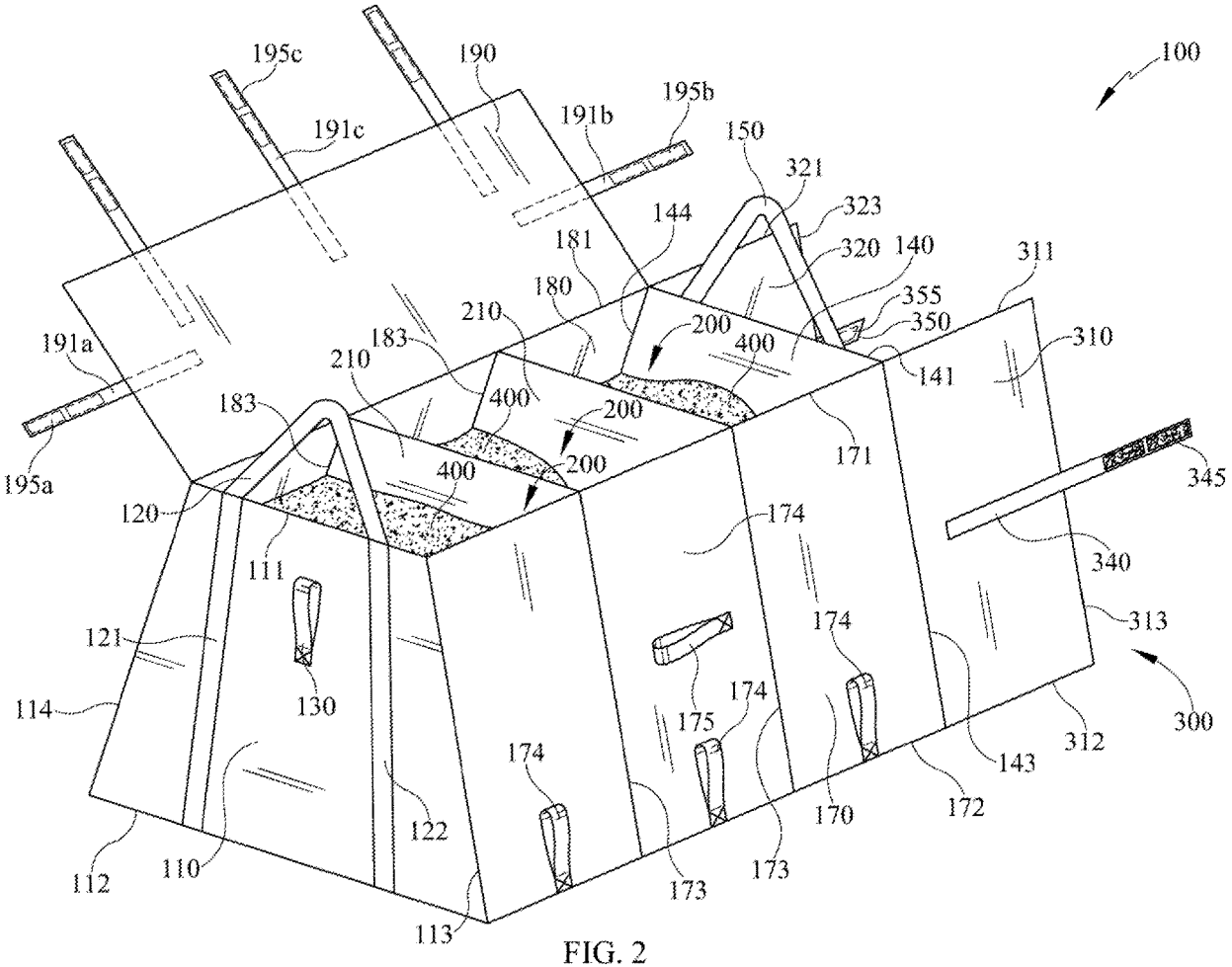
FIG. 2 is a perspective view of the barrier bag of FIG. 1 partially filled with fill material.
Figure 3:
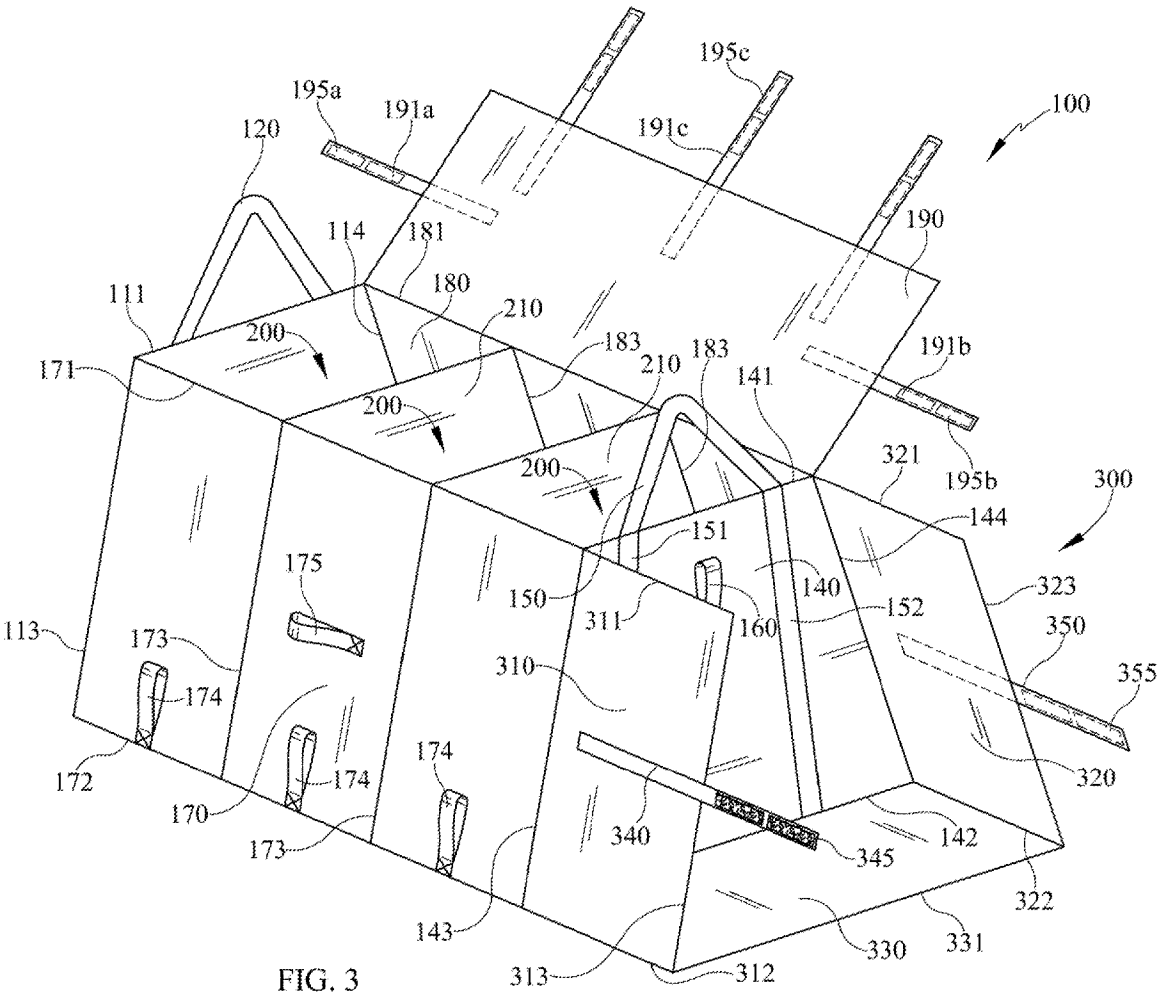
FIG. 3 is another perspective view of the barrier bag of FIG. 1.
Figure 4:
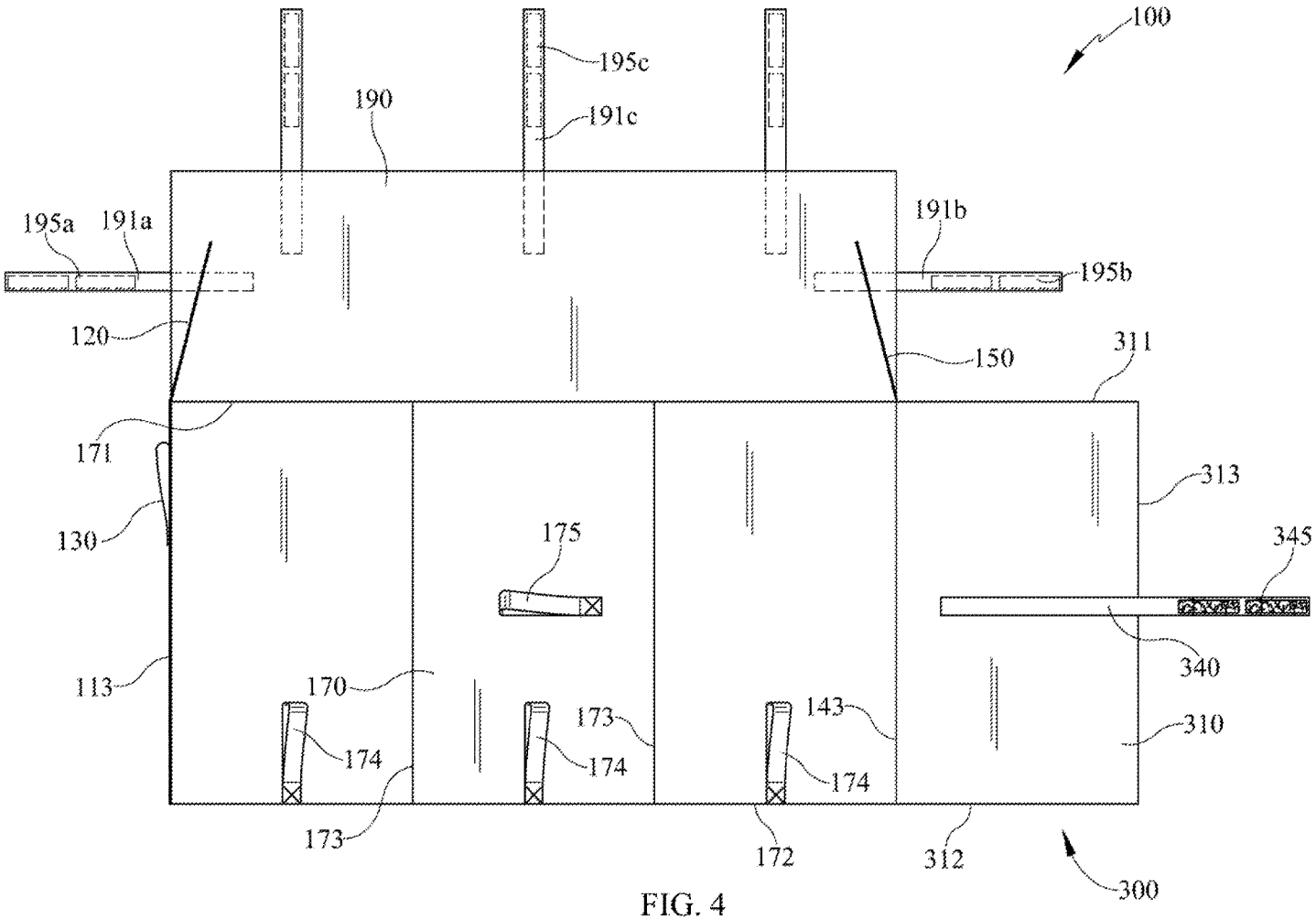
FIG. 4 is a side view of an embodiment of a barrier bag.
Figure 5:
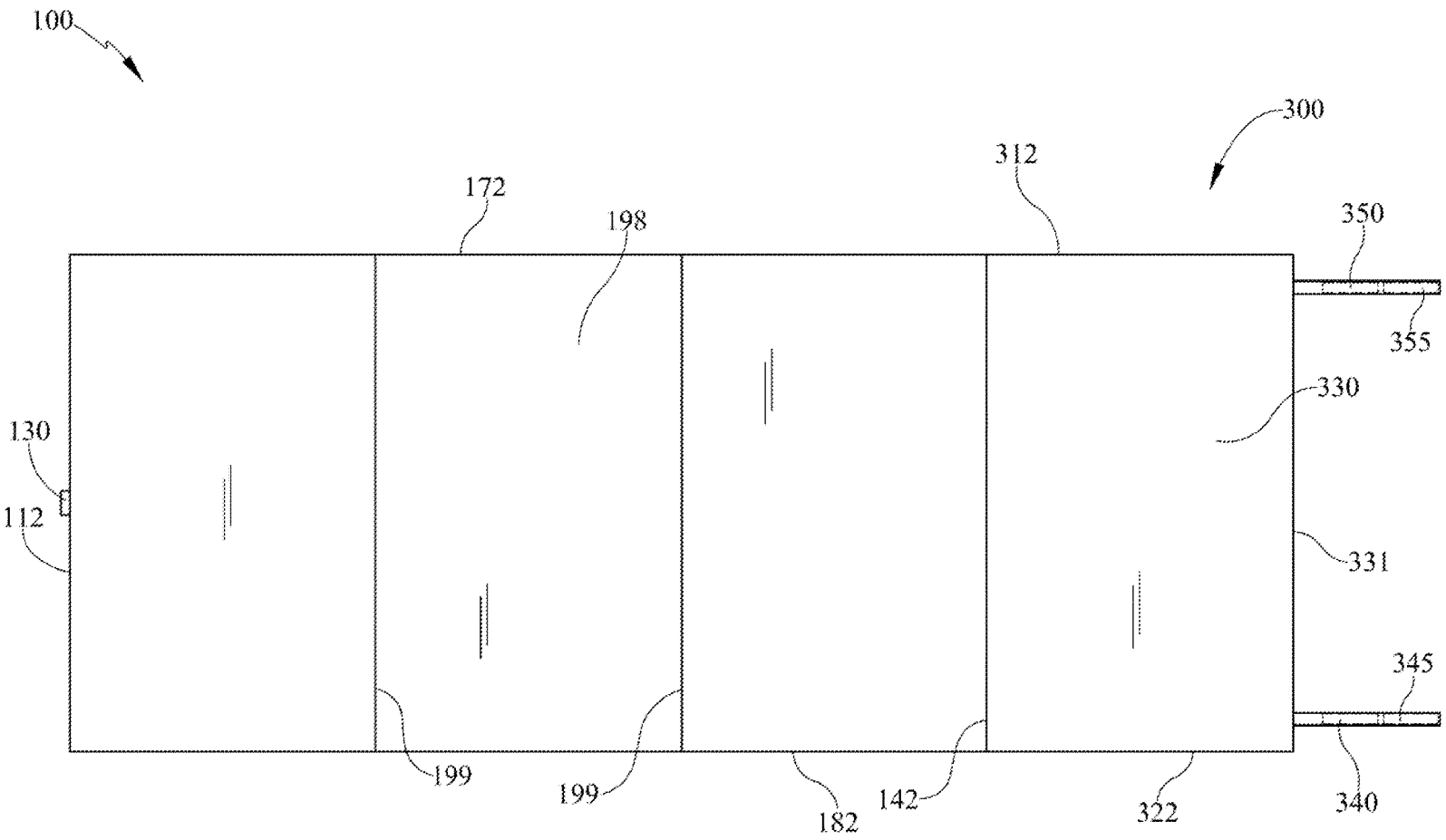
FIG. 5 is a bottom view of an embodiment of a barrier bag.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Referring to FIGS. 1-6, embodiments of a barrier bag 100 are depicted. Barrier bag 100 may include one or more loading cells 200, which collectively may comprise an internal space of barrier bag 100. If more than one loading cell 200 is included, the loading cells 200 may be separated by partitions or baffles 210. Any or all of loading cells 200 may be filled with a fill material 400, which may be a flowable fill material. In this way, barrier bag may be laden with fill material 400 and used as a flood prevention barrier. Barrier bag 100 may be dimensioned so that one or more barrier bags 100 may be placed lengthwise across the bottom of a doorway to prevent or inhibit fluid, such as flood waters, from transgressing the doorway and/or from flowing from one room to another. Inhibiting or preventing flood water from entering one room or space from another can greatly reduce damage caused by flood waters. Barrier bag 100 may have a length in a longitudinal direction from a first end or first end panel 110 to a second end or second end panel 140 that is made to span a doorway. For example, the length of barrier bag 100 may correspond to a standard doorway width or, alternatively, may be approximately half (or some other fraction) of the doorway width so that two or more barrier bags 100 may be serially linked or chained together to form a length sufficient to block a doorway. It is understood, of course, that barrier bag 100 is not limited to being dimensioned for a doorway, and may be dimensioned to span any space, either alone or in combination with other barrier bags 100. The barrier bags 100 may be reusable or nonreusable. It should also be understood that the barrier bags 100 or any portions thereof may be collapsible, such as but not is not limited to the base, lid, and/or receiving cell.

To facilitate interlocking, linking, or chaining of multiple barrier bags 100, whether it be two or more, barrier bag 100 may include a receiving cell 300. Receiving cell 300 may be attached to any or all of second end panel 140, first side panel 170, and second side panel 180, and/or may extend longitudinally outwardly therefrom so as to create a space that may receive and/or support first end panel 110 (and/or some or all of first side 170, second side 180, and/or a bottom or bottom panel 198) therein. To aid in receiving first end panel 110 (and/or some or all of first side 170, second side 180, and/or bottom or bottom panel 198), receiving cell 300 may be open-ended opposite second end panel 140 and/or at the top (for example, opposite a bottom extension panel 330, if it is included). Receiving panel may be sized, shaped, and/or configured similarly to first end panel 110 for any of a variety of reasons, including, but not limited to, facilitating a strong or solid reception and/or attachment of two or more barrier bags 100 and/or enhancing the ability of linked barrier bags 100 to inhibit transgress of flood water (or other fluid). Although the receiving cell 300 allows for the interlocking of two or more barrier bags 100 in a longitudinal direction, it is understood that the receiving cell may additionally or alternatively link barrier bags in a transverse direction to the longitudinal direction.

The open-top internal space, base, or loading cell(s) 200 of barrier bag 100 may substantially be defined on the bottom by bottom panel 198, and/or around the sides by side panels 170, 180 and/or end panels 110, 140. The top of loading cell(s) 200 may be defined by a lid 190 when lid 190 is closed, as discussed in more detail below. Individual loading cells 200, if more than one is included, may be defined on the bottom by bottom panel 198 and on the sides by one or more baffles 210 and/or by any combination of side panels 170, 180 and end panels 110, 140. In some embodiments, first end panel 110 may be connected to: bottom panel 198 at seam 112, first side panel 170 at seam 113, and/or to second side panel 180 at seam 114. First end panel 110 may be defined at the top by top edge 111. In similar fashion, second end panel 140 may be connected to: bottom panel 198 at seam 142, first side panel 170 at seam 143, and/or to second side panel 180 at seam 144. Second end panel 140 may be defined at the top by top edge 141. First side panel 170 may be connected to: bottom panel 198 at seam 172, first end panel 110 at seam 113, and/or to second end panel 140 at seam 143. First side panel 170 may be defined at the top by top edge 171. Second side panel 180 may be connected to: bottom panel 198 at seam 182, first end panel 110 at seam 114, and/or to second end panel 140 at seam 144. Second side panel 180 may be defined at the top by seam 181 where second side panel 180 attaches or connects to lid 190, if lid 190 is included. If lid 190 is not included, seam 181 may merely form a top edge of second side panel 180. Any or all of baffles 210, if included, may be attached to, connected to, and/or included with any or all of end panels 110, 140, side panels 170, 180, and/or bottom panel 198 at, for example, respective seams 173, 183, 199.

Receiving cell 300 may include any or all of bottom extension panel 330, a first extension panel 310, and a second extension panel 320. If included, bottom extension panel 330 may be attached to second end panel 140 and/or bottom panel 198, for example, at seam 142, and/or may extend longitudinally outwardly from second end panel 140 to a terminal end 331. First extension panel 310 may be attached to second end panel 140 and/or first side panel 170 at seam 143, and/or may be attached to bottom extension panel 330 at seam 312, and/or may extend longitudinally outwardly to a terminal end 313. First extension panel 310 may have a top edge 311. Second extension panel 320 may be attached to second end panel 140 and/or second side panel 180 at seam 144, and/or may be attached to bottom extension panel 330 at seam 322, and/or may extend longitudinally outwardly to a terminal end 323. Second extension panel 320 may have a top edge 321. In this way, receiving cell 300 may be attached to barrier bag 100 (or the remainder of barrier bag 100, as receiving cell 300 may be considered a part of, and not an addition to, barrier bag 100) adjacent the second end panel 140.

It is understood that receiving cell 300 may be formed without any or all of bottom extension panel 330, first side or first extension panel 310, and/or second side or second extension panel 320, and other alternatives of forming a functional receiving cell will be readily understood. For example, in some embodiments, receiving cell 300 may be formed by first extension panel 310 and second extension panel 320 without inclusion of bottom extension panel 330. Any or all seams referred to herein may be used to indicate a location where two or more features are connected or intersect. It is understood that any or all seams referred to herein may be formed by any of a variety of methods, including, but not limited to, sewing, stitching, welding, adhering, bonding, or any other method of connection or attachment, and/or any or all seams referred to herein may refer to an intersection point of integral features (e.g., features that form or are formed as a unit and/or have no clear physical separation). In some embodiments, any or all seams may be stitched or sewn to provide sufficient strength and water sealing characteristics. In embodiments including at least some construction from fabric, barrier bag 100 may include stitched or sewn seams as a convenient method of attaching the fabric components.

Figure 6:
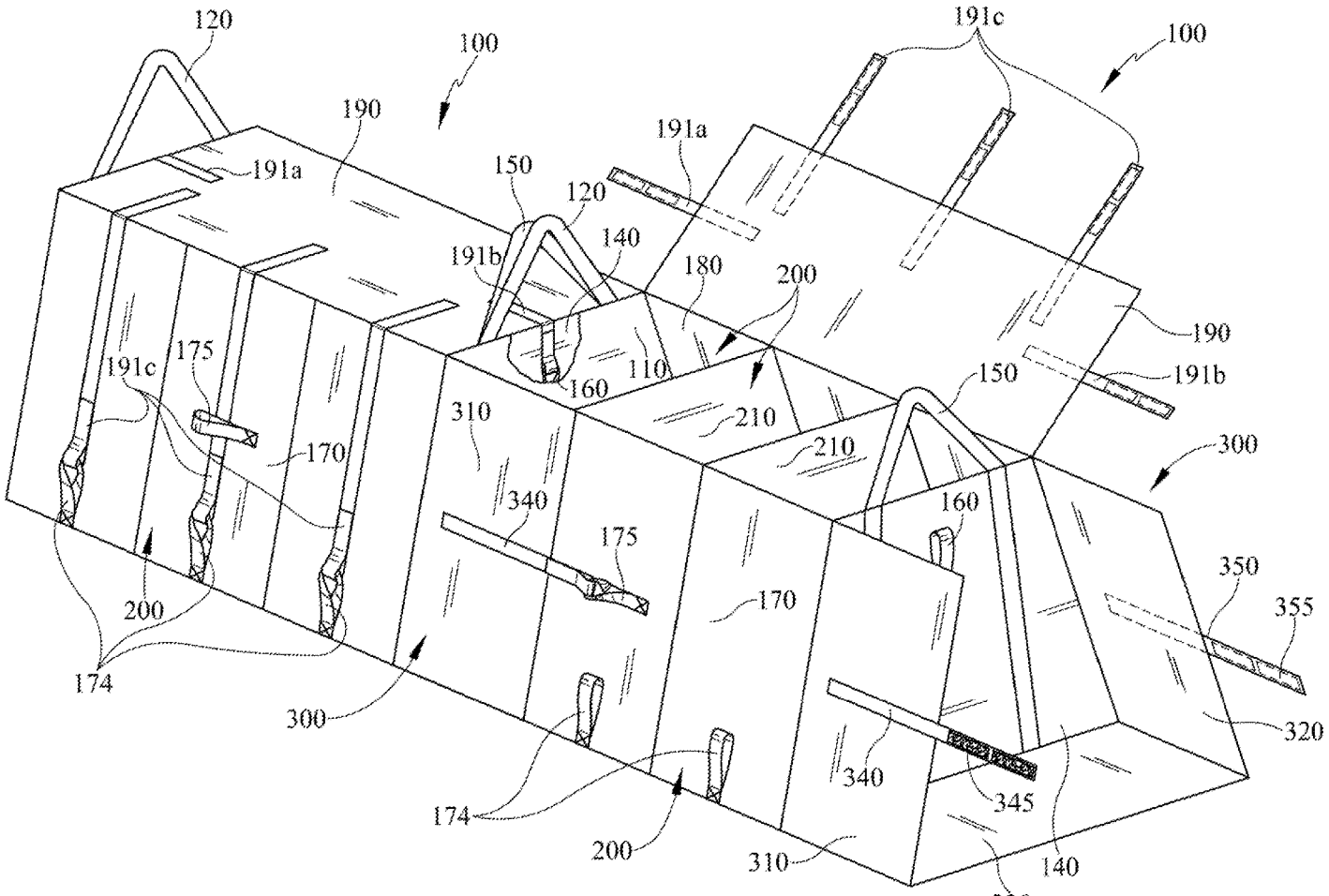
FIG. 6 is a perspective view of the barrier bag of FIG. 1, with the lid in a closed configuration relative to the base, connected to or interlocked with a second barrier bag, with the lid in an open configuration relative to the base.
Figure 7:
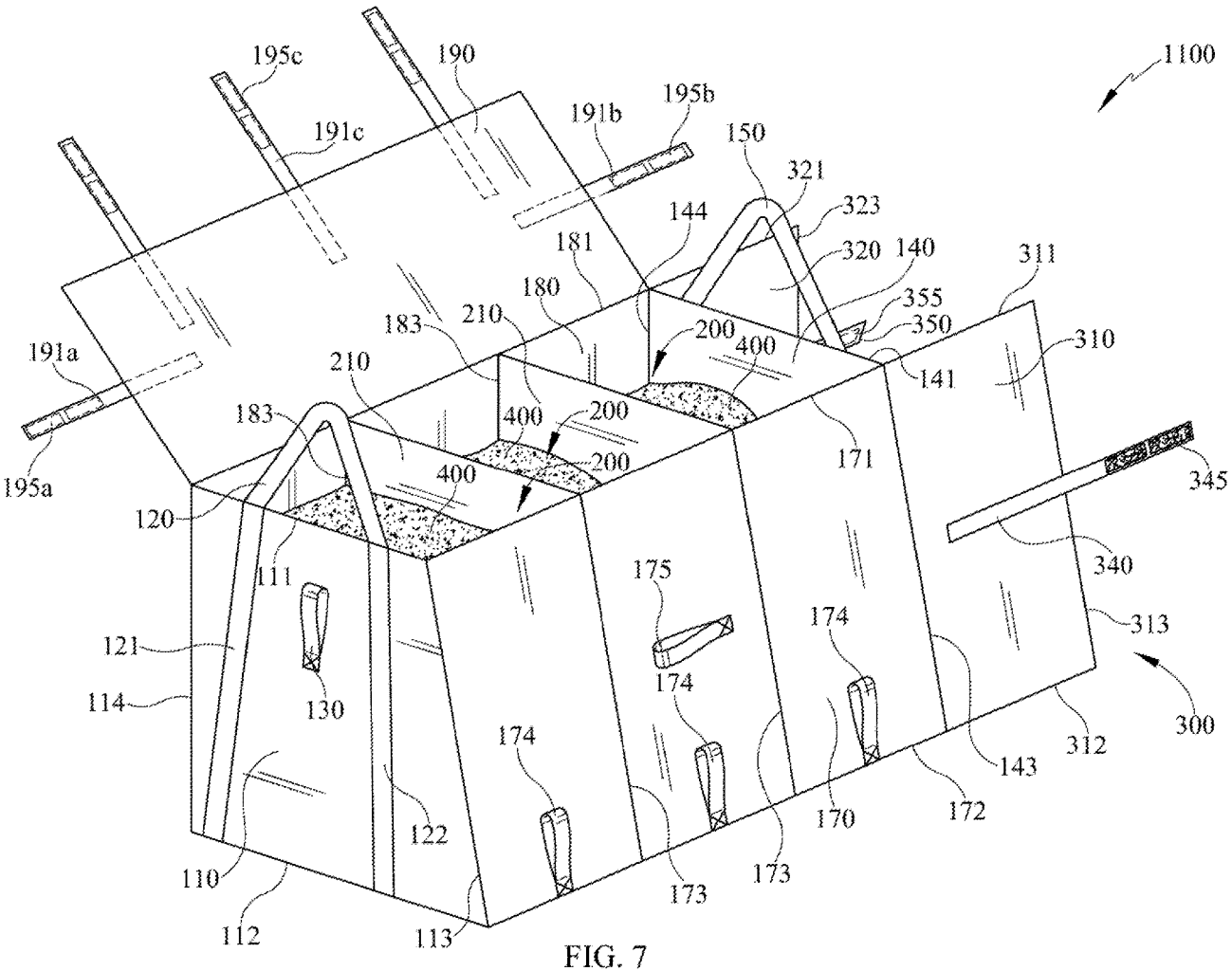
FIG. 7 is a perspective view of another embodiment of a barrier bag partially filled with fill material.
Figure 8:
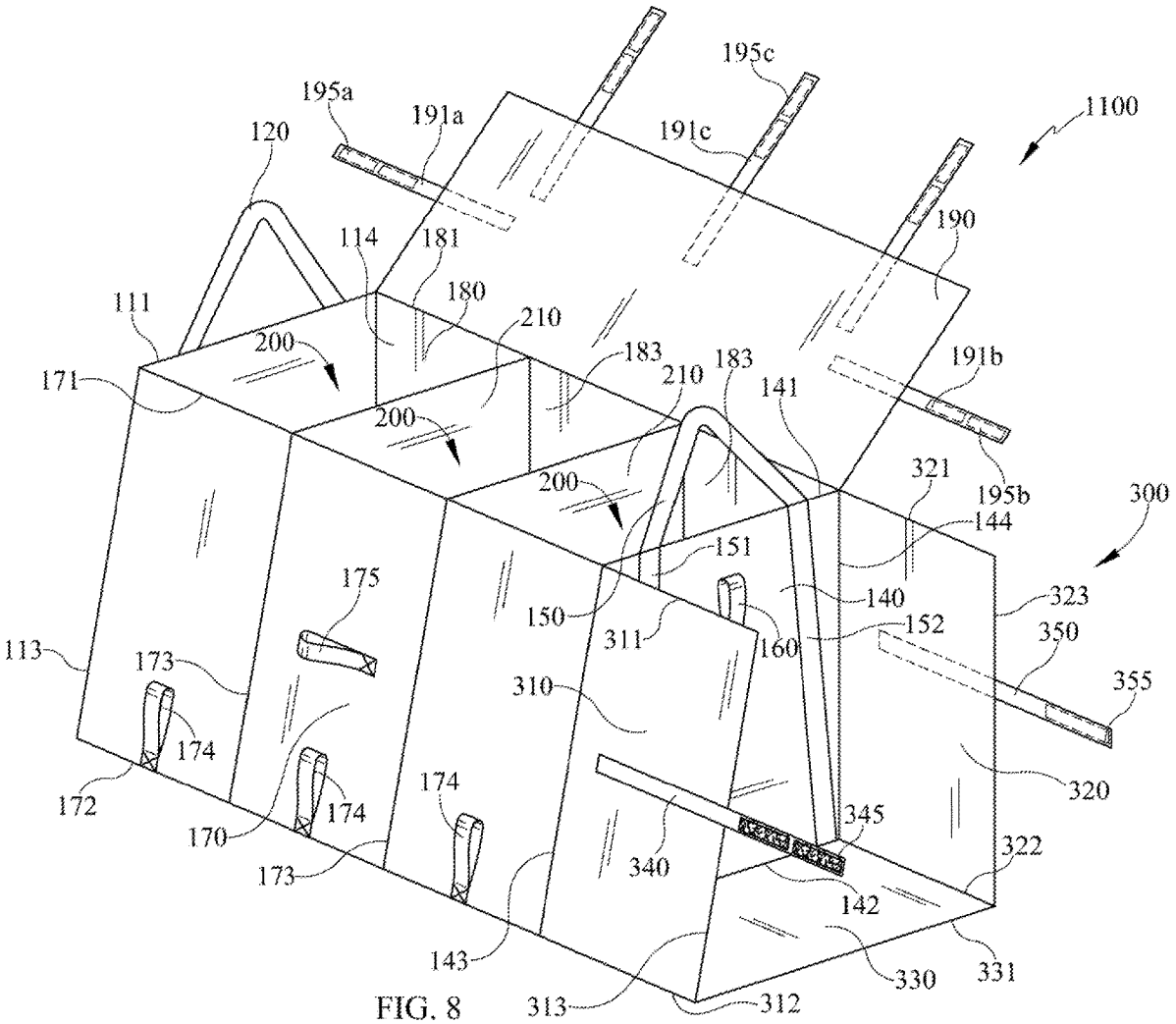
FIG. 8 is another perspective view of the barrier bag of FIG. 7.
Figure 9:
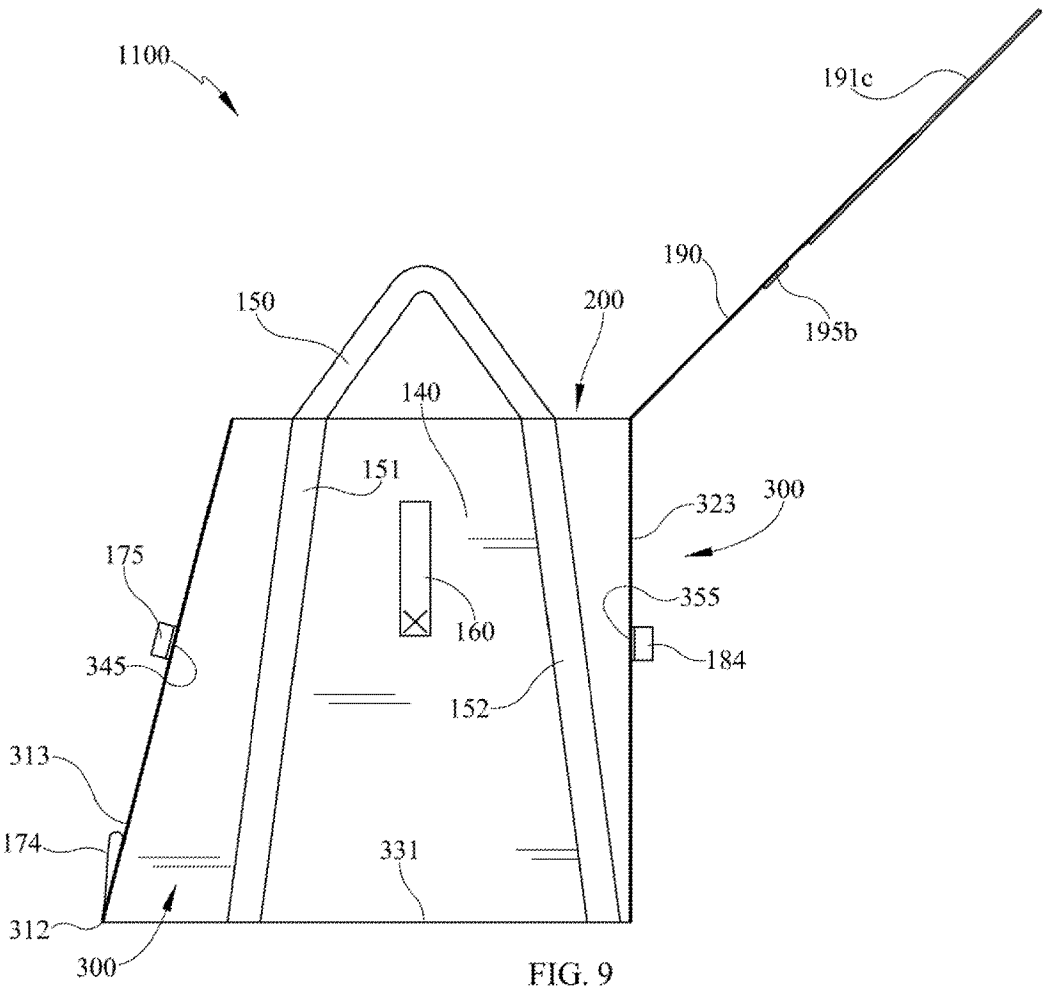
FIG. 9 is a side view of the barrier bag of FIG. 7.

Barrier bag 100 may be removably attachable to an adjacent barrier bag 100. For example, a second barrier bag 100 may be partially inserted into receiving cell 300 of a first barrier bag 100. The first and second barrier bags 100 may then be removably attached, connected, and/or secured together. For example, in some embodiments barrier bag 100 may include one or more attachments or extension straps 340, 350 extending longitudinally beyond terminal end 331, terminal end 313, and/or terminal end 323, if included. In this way, when extended outwardly, and a second barrier bag 100 is partially or fully inserted into a first barrier bag 100, any or all extension straps 340, 350 may be made to overlap a portion of first side panel 170 and/or second side panel 180. Extension straps 340, 350 may include first mating or attachment portions 345, 355 that may be, but is not limited to, hook and loop fasteners. These attachment portions 345 and 355 of a first barrier bag 100 may removably mate or attach to respective second mating or attachment portions 175, 184, respectively, of a second barrier bag 100. The attachment portions 175 and 184 are shown as, but is not limited to, loops. Although second attachment portion 184 is shown more clearly in FIG. 9, it may be substantially similar to second attachment portion 175, but located on the outside surface of second side panel 180 instead of on first side panel 170. In this way, a first barrier bag 100 may be removably attached to a second barrier bag 100 that is at least partially inserted in receiving cell 300 of the first barrier bag 100. In use, the straps 340 and 350 are inserted into their respective loops of the attachment portions 175 and 184, overlapped upon themselves to longitudinally tighten the first barrier bag 100 to the second barrier bag 100 that is inserted in the receiving cell 300 of the first barrier bag, and subsequently secured in their overlapping engagement by their respective hook and loop fasteners 345 and 355 as shown in FIG. 6.

In some embodiments, removable attachment may alternatively be achieved by use of hook-and-loop fasteners split between the straps 340, 350 and the attachment portions 175, 184, instead of being located together on the straps 340 and 350. It is understood that the attachments shown are merely one example of a type of attachment mechanism that may be used and any of a variety of other attachment mechanisms may be used instead of, or in addition to, hook-and-loop style fasteners. For example, first attachment portions 345, 355 may be straps that are tied to respective second attachment portions 175, 184, which in turn may also be straps or loops for tying to first attachment portions 345, 355. In some embodiments, any or all of first attachment portions 345, 355 and/or second attachment portions 175, 184 may include mechanical snaps, screws, bolts, nails, bolts, nuts, adhesives, tongue-and-groove style fasteners, belts (e.g., belt and D-ring style fasteners), tie offs, or any other attachment mechanism, or any combination thereof. It is understood that these are merely examples and that any type of attachment mechanism may be used to releasably or fixedly secure the first barrier bag 100 to one or more additional barrier bags 100.

Lid 190 may be attached to, connected to, and/or included with barrier bag 100, for example, at seam 181. Seam 181 may act as a hinge to allow swinging motion of lid 190 relative to second side panel 180 and thereby allow opening and closing of the tops of any or all loading cells 200 or the internal space of barrier bag 100. In this way, enclosure of the interior space or loading cell(s) 200 may be achieved in combination with any or all of bottom panel 198, side panels 170, 180, and end panels 110, 140. Once any or all loading cells 200 or the interior space has been filled with fill material 400 as desired (if desired), lid 190 may be closed to substantially enclose fill material 400 and/or top of the internal space or loading cell(s) 200. Closure of lid 190 may, for example, aid in retaining fill material 400 within the internal space or loading cell(s) 200 and/or may improve the ability of one barrier bag 100 to be stacked on top of another barrier bag 100.

Lid 190 may include one or more lid end straps or attachments 191*a*, 191*b* and/or one or more lid side straps or attachments 191*c*, which may be used to attach, removably or otherwise, lid 190 to first end panel 110, second end panel 140, and/or first side panel 170 in order to secure the lid 190 relative to the base 200 in a closed position. Any or all lid straps 191*a*, 191*b*, 191*c*, if included, may include mating or attachment portions 195*a*, 195*b*, 195*c* that may be, but is not limited to, hook and loop fasteners. These attachment portions 195*a*, 195*b*, and 195*c* may be removably attachable to corresponding respective mating or attachment portions 130, 160, 174 located on first end panel 110, second end panel 140, and first side panel 170, respectively. More specifically, one embodiment illustrates the end lid attachment portions 130, 160 and side lid attachment portions 174 are shown as, but are not limited to, loops. In use, the straps 191*a*, 191*b*, and 191*c* are inserted through their respective loops of the attachment portions 130, 160, and 174, overlapped upon themselves to tighten the lid 190 to the base 200 to enclose the material 400, and subsequently secured in their overlapping engagement by their respective hook and loop fasteners 195*a*, 195*b*, and 195*c* as shown in FIG. 6. As mentioned above, with respect to first attachment portions 345, 355 and/or second attachment portions 175, 184, in some embodiments, any or all attachment portions 195*a*, 195*b*, 195*c*, 130, 160, 174 may include hook-and-loop style fastener portions that are separated on either the strap and loop, mechanical snaps, screws, bolts, nails, bolts, nuts, adhesives, tongue-and-groove style fasteners, belts (e.g., belt and D-ring style fasteners), tie offs, or any other attachment mechanism, or any combination thereof. It is understood that these are merely examples and that any type of attachment mechanism may be used to releasably or fixedly secure the lid 190 to the base 200.

In some embodiments, handles 120, 150 may be included to, for example, facilitate manually lifting and moving barrier bag(s) 100. If included, handles 120, 150 may be attached to, connected to, and/or included with end panels 110, 140, and/or may extend above respective side panel top edges 111, 141. It is understood that any number of handles 120, 150 may be included and may be located at virtually any location or locations on barrier bag 100. Handles 120, 150 may be attached to end panels 110, 140 via, for example, straps 121, 122, 151, 152 that may be attached to, connected to, or included, by any of a variety of methods, including, but not limited to, sewing, stitching, welding, adhering, bonding, or any other method of connection or attachment, or any combination thereof.

Barrier bag 100 and/or receiving cell 300 are shown as being substantially trapezoidal in cross-sectional shape substantially perpendicular to the longitudinal direction of barrier bag 100, which, in some embodiments, may aid in stacking multiple barrier bags 100 top to bottom. Although shown as having a substantially trapezoidal cross-sectional shape, it is understood that barrier bag 100 and/or receiving cell 300 may be any of a variety of shapes, including, but not limited to, rectangular, square, triangular, polygonal, ovular, round, circular, or any other shape, or any combination thereof. For example another embodiment as illustrated in FIGS. 7-10 includes a cross-sectional shape that may be, but is not limited to, a substantially right trapezoidal shape with two adjacent right angles adjacent one of the lateral side panels such that one side panel 180 is substantially vertical and the opposite side panel 170 being transverse thereto. It is further understood that, although receiving cell 300 is depicted as having substantially the same cross-sectional shape as barrier bag 100 (or the remainder thereof), receiving cell 300 may, in some embodiments, be shaped independently of barrier bag 100 (or the remainder thereof). Further still, it is understood that, although barrier bag 100 and receiving cell 300 are each shown having a substantially uniform cross-sectional shape, no such uniformity is required and either or both of barrier bag 100 and receiving cell 300 may have varying cross-sectional shapes.

Barrier bag 100, receiving cell 300, and/or any portion of either, may be made of any of a variety of materials including, but not limited to, polypropylene, high strength canvas or the like. It may be desirable to incorporate material which is impervious to water and which sufficiently retains the fill material 400 therein. The fill material 400 may include not only sand, dirt or other fill material but may also include concrete and the like (e.g., should a permanent structure be intended).

In use, one or more barrier bags 100 may be used to form a barrier by depositing fill material 400 into the barrier bags 100, for example, by filling one or more loading cells 200. One application may be a barrier for a doorway. The first end or end panel 110 of a first barrier bag 100 may then be at least partially inserted into the receiving cell 300 of a second barrier bag 100, as shown in FIG. 6. The lid 190, if included with either or both (or more, if included) of the barrier bags 100 may then be closed to enclose fill material 400 within barrier bags 100, for example, substantially as described above.

Figure 10:
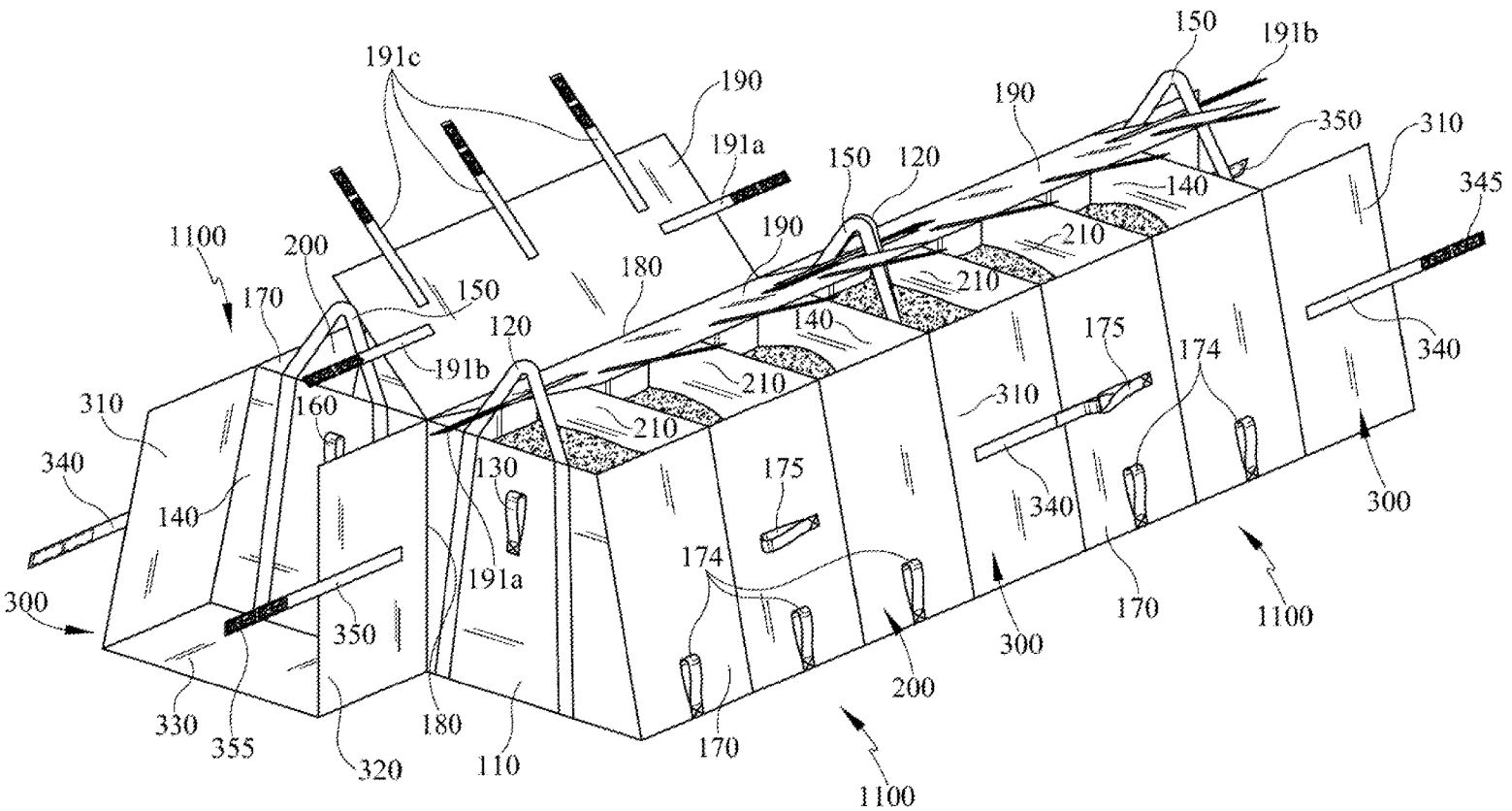
FIG. 10 is a perspective view of the barrier bag of FIG. 7 connected to or interlocked with a second barrier bag in a longitudinal direction with each of the lids in an open configuration relative to their base, and also illustrates another relationship between barrier bags such that a third barrier bag is laterally stacked in a back-to-back relationship with another barrier bag.

As illustrated in FIGS. 7-10, another embodiment of the barrier bag 1100 is shown that is similar to the embodiment 100 except that at least one lateral side of the barrier bag 100 and/or receiving cell 300 is substantial vertical or alternatively may not be the same length as the other lateral side. Therefore the barrier bag 1100 and/or base 200 may still be trapezoidal in shape in cross-section to the longitudinal direction if desired. Barrier bag 1100 may include a substantially vertical second side panel 180. Thus, the second side panel 180 forms two adjacent right angles, one adjacent the lid 190 or the top of the bag or base 200 and another adjacent the bottom panel 198 or bottom of the bag or base 200. First side panel 170 is angled or transverse relative to the second side panel 180. If the lid 190 is included, the second side panel 180 may include the lid 190 as shown. Alternatively, the lid 190 may extend from the first side panel 170. Similarly, it is further shown that the receiving cell 300 includes a second extension panel 320 that may be substantially vertical and extending longitudinally from the second side panel 180. Therefore receiving cell 300 may still be trapezoidal in shape in cross-section to the longitudinal direction if desired. Similar in use, one or more barrier bags 1100 may be filled or refilled with a material 400) and placed in a position to reduce the ingress of flood waters. More specifically, barrier bag 1100 may be placed adjacent an object such as, but not limited to, a door, wall, or other structure having a substantially vertical surface, such that the vertical side panel 180 of the base 200 and/or second extension panel of the receiving cell 300 may be abutted to or adjacent the vertical surface of the object in a variety applications. This application is not considered to limiting. As such the second side panel 180 and/or second extension panel 320 of one or more barrier bags 100 will be substantially flush to or parallel with the object's substantially vertical surface to which it is positioned adjacent to. Similar as described above and shown in FIG. 10, the first end or end panel 110 of a first barrier bag 1100 may be at least partially inserted into the receiving cell 300 of a second barrier bag 1100 to longitudinally adjust the desired length of combined bags 1100 to reduce the ingress of flood waters. It is to be understood that the barrier bags 1100 may be stacked, vertically and/or laterally, and/or lengthened and may be used in a variety of applications beyond being positioned against a substantially vertical surface. By further example as shown in FIG. 10, two side panels 180 of bags 1100 may also be positioned adjacent to each other in a back-to-back relationship to create a combined second trapezoidal cross-sectional shape that is different than the first trapezoidal cross-sectional shape of the individual barrier bag 1100. The combined second trapezoidal shape may be, but is not limited to, similar to the cross-sectional shape of barrier bag 100 and used in similar applications. For example, at least two bags 1100 combined back to back at their side panels 180, as shown in FIG. 10, may be longitudinally received by receiving cell 300 of one or more connected barrier bags 100. It should also be understood that one or more barrier bags 1100 and/or barrier bags 100 alone or in combination may be used in a variety of positions and orientations relative to each other to lengthen and/or stack, vertically or laterally, for a given barrier application.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A door barrier bag, comprising:

at least one loading cell, wherein said at least one loading cell includes a bottom panel and a plurality of side panels creating an open-top internal space capable of receiving flowable fill material;

a first end panel and a second end panel at opposing longitudinal ends of said barrier bag; and a substantially open-ended receiving cell at said second end panel of the barrier bag configured to removably attach to the first end panel of an additional barrier bag by a removable strap extending from a lid of the door barrier bag to an interior end wall of the additional barrier bag having a strap receiving structure.

2. The door barrier bag of claim 1, wherein said open-top internal space may contain partitions separating individual loading cells.

3. The door barrier bag of claim 1, wherein said open-top internal space of one said at least one loading cell is substantially defined by a bottom panel, a first side panel, a second side panel, a first end panel, and a second end panel.

4. The door barrier bag of claim 1, wherein said receiving cell includes at least one of a bottom extension panel, a first side extension panel, and a second side extension panel extending longitudinally outwardly from said second end panel.

5. The door barrier bag of claim 4, wherein said receiving cell includes one or more extension straps extending longitudinally beyond a terminal end of said receiving cell configured to removably attach to respective attachment portions of another barrier bag.

6. The door barrier bag of claim 1, wherein said barrier bag wherein the lid is provided for enclosure of said open-top internal space.

7. The door barrier bag of claim 6, wherein said lid is removably attached to at least one of said first side panel and said second side panel.

8. The door barrier bag of claim 7, wherein at least one of said first end panel, said second end panel, said first side panel, and said second side panel includes one or more handles.

* * * * *